US006772669B1

(12) United States Patent
Stålhandske et al.

(10) Patent No.: US 6,772,669 B1
(45) Date of Patent: Aug. 10, 2004

(54) METHOD AND ARRANGEMENT FOR LOADING ARTILLERY PIECES BY MEANS OF FLICK RAMMING

(75) Inventors: Kent Stålhandske, Karlskoga (SE); Sven-Erik Engström, Karlskoga (SE); Sten Hallqvist, Vingåker (SE); Torbjörn Sandberg, Göteborg (SE)

(73) Assignee: Bofors Defence Aktiebolag, Karlskoga (SE)

( * ) Notice: Subject to any disclaimer, the term of this patent is extended or adjusted under 35 U.S.C. 154(b) by 0 days.

(21) Appl. No.: 10/088,894

(22) PCT Filed: Sep. 20, 2000

(86) PCT No.: PCT/SE00/01819

§ 371 (c)(1),
(2), (4) Date: Jul. 16, 2002

(87) PCT Pub. No.: WO01/22022

PCT Pub. Date: Mar. 29, 2001

(30) Foreign Application Priority Data

Sep. 23, 1999 (SE) ..... 9903440

(51) Int. Cl.[7] ..... F41A 9/42
(52) U.S. Cl. ..... 89/47
(58) Field of Search ..... 89/45, 46, 47, 89/33.05

(56) References Cited

U.S. PATENT DOCUMENTS

| | | | | | |
|---|---|---|---|---|---|
| 1,602,568 | A | | 10/1926 | Conlon | 89/47 |
| 2,399,722 | A | * | 5/1946 | Cotter et al. | |
| 3,241,447 | A | * | 3/1966 | Christiansson | 89/47 |
| 3,938,421 | A | * | 2/1976 | Nordmann | 89/47 |
| 4,457,209 | A | | 7/1984 | Scheurich et al. | 89/45 |
| 4,727,790 | A | * | 3/1988 | DeHaven et al. | 89/46 |
| 4,957,028 | A | | 9/1990 | Lieberum et al. | 89/47 |
| 4,961,370 | A | * | 10/1990 | Sawyer | 89/47 |
| 5,131,316 | A | * | 7/1992 | Lawrence et al. | 89/46 |
| 5,261,310 | A | * | 11/1993 | Sullivan et al. | 89/46 |
| 5,353,678 | A | | 10/1994 | Rochelle et al. | 89/9 |
| 5,756,923 | A | * | 5/1998 | Golden et al. | 89/46 |
| 5,773,747 | A | * | 6/1998 | Tellander et al. | 89/47 |
| 5,831,201 | A | * | 11/1998 | Andersson et al. | 89/45 |

FOREIGN PATENT DOCUMENTS

DE 38 26 350 A1 * 3/1990

* cited by examiner

*Primary Examiner*—Stephen M. Johnson
(74) *Attorney, Agent, or Firm*—Connelly Bove Lodge & Hutz LLP; Larry J. Hume

(57) ABSTRACT

A method and arrangement for flick ramming projectile components such as shells or propellant powder charges in artillery pieces is disclosed which accelerates the projectile component to the necessary ramming velocity using an electromechanically generated energy supply in the form of starting acceleration from an electric motor. The rotating starting acceleration of the electric motor is mechanically converted into rectilinear acceleration, and the electric motor may be supplemented wit an energy supply obtained from a previously charged energy accumulator which is triggered simultaneously with the start of the electric motor.

15 Claims, 9 Drawing Sheets

METHOD AND ARRANGEMENT FOR LOADING ARTILLERY PIECES BY MEANS OF FLICK RAMMING

BACKGROUND OF THE INVENTION

The present invention relates to a method and an arrangement for flick ramming shells and propellant powder charges in artillery pieces which are loaded with these components separately.

The expression flick ramming means that the components making up the charge, in the form of shells and propellant powder charges, are, during the start of each loading operation, imparted such a great velocity that they perform their own loading operation up to ramming in the barrel of the piece in more or less free flight at the same time as the loading cradle in which they are accelerated to the necessary velocity is rapidly braked to a stop before or immediately after it has passed into the loading opening of the barrel.

Flick ramming is an effective way of driving up the rate of fire even in heavier artillery pieces, and, in this connection, it is in general terms necessary for the shells, for example, to be imparted a velocity of at least approaching 8 metres per second in order for flick ramming to be performed. It is moreover desirable that the ramming velocity can be varied in relation to the elevation of the piece so that the shells are always rammed equally firmly in the loading space of the piece. This is because, in this way, variations of Vo, that is to say the muzzle velocity, as a result of shells/projectiles being rammed with varying degrees of firmness are avoided.

The major problem associated with flick ramming heavier artillery shells/projectiles is that of accelerating these to the necessary final velocity within the acceleration distance available, which is usually no longer than the length of the shell or projectile itself. Furthermore, it must be possible to flick ram different types of shell/projectile of different weight and length using one and the same rammer. A further complication in flick ramming shells/projectiles, and to a certain extent in flick ramming propellant powder charges, is that, as soon as they have reached the desired velocity, the rammer or the shell cradle with which they have been accelerated to the desired flick ramming velocity must be rapidly braked to zero while the accelerated shell or propellant powder charge continues its course forwards and into the loading opening of the piece as a freely moving body.

Thus far, the practice has primarily been to use pneumatically driven flick rammers in which a pneumatic accumulator provided the necessary energy to impart the requisite flick velocity to the shell in question. In conventional rammers which do not provide flick ramming, there are often chain transmissions for transferring the energy supply between an axially displaced hydraulic or pneumatic piston and the rammer which acts directly on the rear part of the shell.

U.S. Pat. No. 4,457,209, in which chiefly FIGS. 12 and 18 are of interest, can be cited as an example of a hydraulically driven shell rammer, while U.S. Pat. No. 4,957,028 constitutes an example of a purely piston-driven rammer.

SUMMARY OF THE INVENTION

The present invention relates to an electrically driven flick rammer for artillery pieces. The rammer according to the invention is to begin with characterized in that, for the acceleration of the shells and, where appropriate, the propellant powder charges, it utilizes the starting acceleration from an electric motor, the rotating movement of which is mechanically geared down and converted into a rectilinear movement. According to a development of the invention, it is moreover possible, when necessary, to make use of an extra energy supply from a chargeable energy accumulator which has previously been provided with an energy supply and is then triggered simultaneously with the driving electric motor of the flick rammer being started, and which thus makes even more rapid acceleration possible. In one of the exemplary embodiments which illustrate the invention, the ramming velocity obtained according to the basic principle of the invention is geared up by a specific mechanical arrangement.

The basic construction of the electrically driven flick rammer according to the invention can therefore be used for ramming both shells and propellant powder charges, the difference being chiefly that, as far as ramming shells is concerned, it is as a rule only these which are accelerated to flick velocity in a fixed loading cradle, whereas, in the case of propellant powder charges, it may be necessary to accelerate the loading cradle as well and allow it to follow the charges into the loading opening of the barrel because the propellant powder charges may have poor inherent rigidity.

The advantages of driving the rammer electrically instead of hydraulically or pneumatically include the fact that the rammer can thus be made much more simple and have fewer component parts and can thus be expected to have a greater degree of availability, at the same time as it becomes possible, by means of electronic control of the driving electric motor, to adjust the ramming velocities accurately at all the elevations of the piece, so that ramming is always the same. The electric motor can therefore also be used to brake the ramming velocity in the event that the energy supply provided by the energy accumulator is too great in relation to the piece elevation at the time.

The basic idea underlying the present invention is therefore that, for loading artillery pieces, use is to be made of the starting acceleration of an electric motor in order to accelerate the artillery propellant powder charge or the shell to be loaded into the piece to such a great velocity that it is sufficient for flick ramming the same. For this to be possible, the rotating movement of the electric motor must, as already mentioned, be converted into a linear movement. In connection with the invention, two different basic principles for this are proposed, one of which is based on the use of a drive belt or feed chain driven by the geared-down electric motor via preferably a bevel gear or a planetary gear, while the other is based on the use of a pinion which is connected to the electric motor and drives a rack in the desired axial direction. The invention also includes a method and a number of arrangements which make possible electrically driven flick ramming of both propellant powder charges and shells, in which the energy supply from the electric motor is combined with that from the energy accumulator, the accumulated energy of which is discharged at the same time and parallel to the motor being started. As the shells have such a great dead weight, an energy supply of not inconsiderable magnitude is necessary in addition to an electric motor, which gives rise to a linear movement in the manner already indicated, so as to keep the size of the motor within reasonable limits. According to the basic concept in question, the energy supply which is therefore necessary in addition to the motor is provided by triggering the energy accumulated in an energy accumulator simultaneously with the electric motor being started. During acceleration itself, the shells must have a certain support in the form of a shell cradle, and, in this, they are accelerated to the desired ramming velocity by a shell rammer. The latter must in turn be stopped rapidly before it arrives in the loading opening of the piece. Some of the braking energy developed in this connection can then be used for at least partial recharging of the energy accumulator. According to a preferred development of the invention, the electric motor, which constitutes the core itself of the system, can subsequently be used to complete the recharging of the energy accumulator. In this connection, the simplest way of carrying out this recharging of the energy accumulator is to reverse the electric motor, the other parts of the rammer then following. In addition to the electric motor and the energy accumulator, the rammer according to the invention also requires a locking function which ensures that the energy accumulator is triggered at the correct moment, that is to say simultaneously with the electric motor being started. In this connection, the motor can be used to provide the locking function. The part referred to above as the energy accumulator can advantageously consist of a compressible spring means in the form of one or more interacting coil or pneumatic springs of a type known per se provided that it is possible to achieve sufficient energy accumulation capacity with these.

As already indicated, the basic idea of the electric motor-driven rammer, with its energy accumulator for making possible ramming of even heavy shells, allows scope for a number of different detailed embodiments. There are therefore a number of different ways in which the accelerating rotation of an electric motor can be converted into a likewise accelerating rectilinear movement, at the same time as there are a number of different ways of embodying the energy accumulator. A few different preferred ways of embodying the arrangement according to the invention will therefore be described in greater detail below. One of the examples described also comprises, in addition to the basic concept of the invention, a development of the same which makes possible mechanical gearing-up of the ramming velocity to a higher level than is achieved according to said basic concept. The variants described in connection with the appended figures are, however, to be seen only as examples of a few embodiments of the invention, while the latter is as a whole defined in the patent claims below.

DESCRIPTION OF PREFERRED EMBODIMENTS

Figure 1:
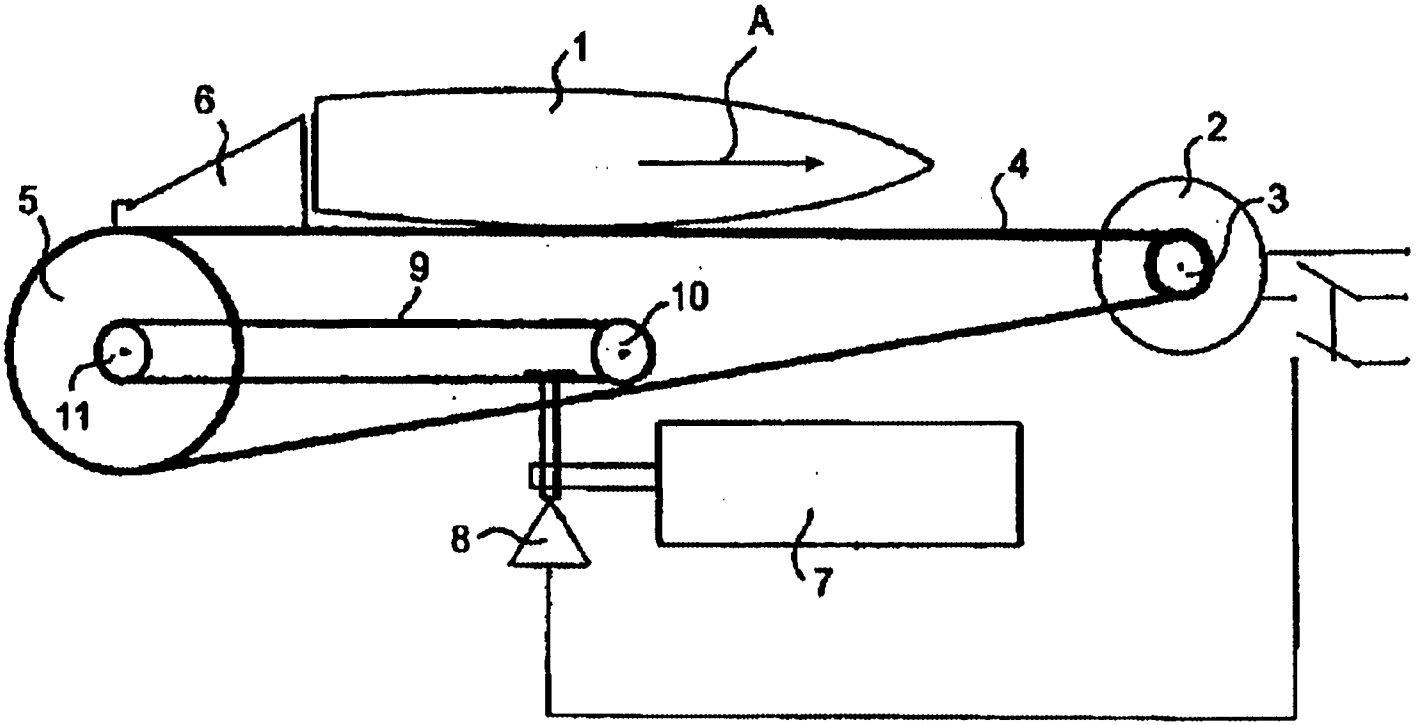
FIG. 1 shows the basic principle of the invention.

FIG. 1 shows diagrammatically the basic principles of the invention in its simplest variant as far as ramming shells is concerned. In the figure, the shell has the reference number 1, while 2 indicates the electric drive motor and 3 the drive wheel of the motor. A feed chain 4 runs around the drive wheel 3 and also around a chain wheel 5 which is driven by the chain but is considerably larger than the wheel 3 and will therefore rotate at a considerably lower speed. By using the feed chain 4, the rotating movement of the electric motor 2, and then chiefly its starting acceleration which is the motor movement of which use is mainly made in application of the invention, is therefore converted into a linear movement which is transmitted to the shell 1 via a shell rammer 6. The acceleration imparted to the shell therefore originates from the starting acceleration of the electric motor. However, the great weight of the shell 1 makes it necessary to provide additional energy as otherwise the motor would have to be exceptionally large, and, according to the invention, this extra energy supply is provided by energy accumulated in an energy accumulator 7 at an earlier stage being released at the same time as the electric motor 2 is started. In its simplest form, the energy accumulator 7 consists of a coil or pneumatic spring which is compressed in its charged state. To trigger the energy accumulator, a locking system 8 is included, as indicated in the figure, which is operationally linked to the starting of the electric motor and which is disconnected at the same time as the electric motor 2 is supplied with starting current The locking system 8 can advantageously, before starting, be replaced by the motor 2 being loaded in the braking direction, that is to say the direction in which it locks or counteracts the energy accumulator, after which the current direction is switched and increased to its maximum value at the same time as the energy accumulator 7 is trigger. This starting method results in an even more rapid start and therefore greater shell acceleration. To transmit the energy supply from the energy accumulator 7 to the feed chain 4 and thus to the rammer 6 and finally to the shell 1, there is also a second feed chain 9 which runs around on the one hand a guide wheel 10 and on the other hand a drive wheel 11, the latter being mounted firmly on the same spindle as the chain wheel 5 and therefore in turn driving it. When the electric motor 2 is started, the energy supply from the motor is imparted to the feed chain 4, and at the same time the energy accumulator 7 therefore delivers Its energy supply, also to the feed chain 4, via the second feed chain 9, the combined energy supply from these two energy sources accelerating the shell 1 in the direction of the arrow A to a velocity which is sufficiently high for the shell to proceed to ramming in the ramming position of the piece (not shown). As soon as the shell has achieved the necessary velocity, the rammer 6 is braked to a stop, which takes place at the latest in line with the spindle of the drive wheel 3. The fact that the electric motor has an important role to play in the system can also be used in order to brake the ramming velocity of the shell if the energy supply from the energy accumulator should be too great in any position. Electronically controlling an electric motor using, for example, a velocity sensor as a point of reference is after all a simple routine procedure today. The simplest way or recharging the energy accumulator is, moreover, to reverse the electric motor until it has returned to the original position.

Figure 2:
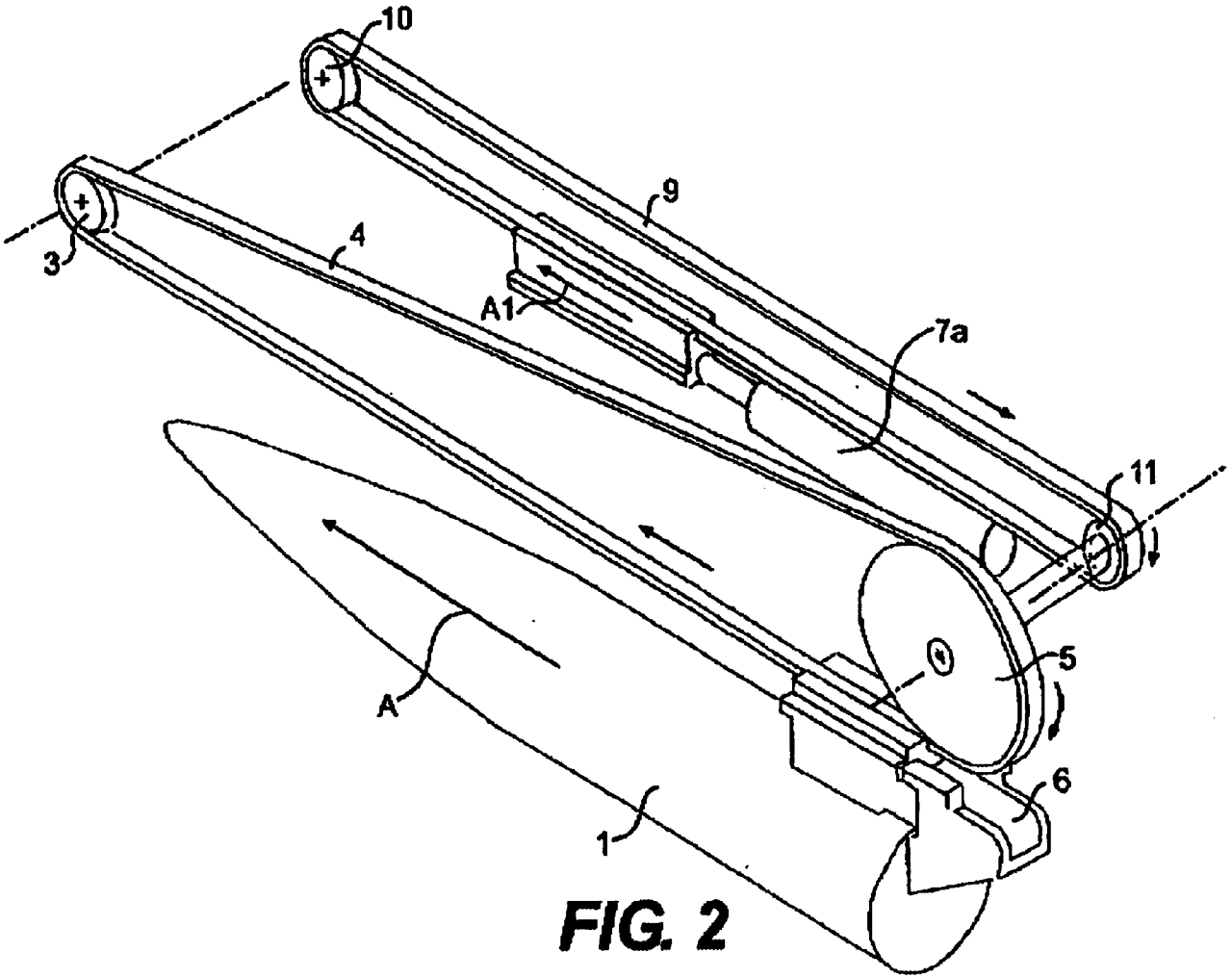
FIG. 2 shows the same variant as in FIG. 1 but in an angled projection and with some component parts omitted so as to clarify the main principle.

FIG. 2 shows in principle the same arrangement as in FIG. 1 but in an angled projection and without the motor 2. In this case, it is assumed that the motor 2 is used to keep the system locked up to the start, for which reason the locking system 8 has been omitted. Otherwise, the various component parts have been given the same reference numbers as in FIG. 1. The motor 2 (not shown) is therefore assumed to be coupled to the drive wheel 3 and thus to drive it via the feed chain 4 running around the wheel 5, to which chain the shell rammer 6 is fixed. The second feed chain 9 runs around the guide wheel 10 and the drive wheel 11 which is mounted firmly on the same spindle as the wheel 5, while the body of the pneumatic spring 7*a* is fixed in a stand (not shown) and its piston rod is connected to the feed chain 9 which it drives in the direction of the arrow A1 when it is released. A number of additional arrows, which indicate the movements of the various feed chains 4 and 9, have also been included in the figure. As can be seen from the figure, starting the motor 2 (not shown) therefore results in the shell 1 being accelerated in the direction of the arrow A1 by the combined starting acceleration from the motor 2 (not shown) and the pneumatic spring 7*a*. To recharge the energy accumulator, that is to say the pneumatic spring 7*a*, all that is necessary is for the motor 2 to be reversed until the pneumatic spring has been compressed again, after which the system is locked by motor braking and the system is ready for a new operating sequence. It is assumed that, during its acceleration, the shell 1 rests in a system-integral shell cradle which can be in the form of a completely or partly covered channel or the like. However, for the sake of clarity, the shell cradle has not been shown in FIGS. 1 and 2.

Figure 3:
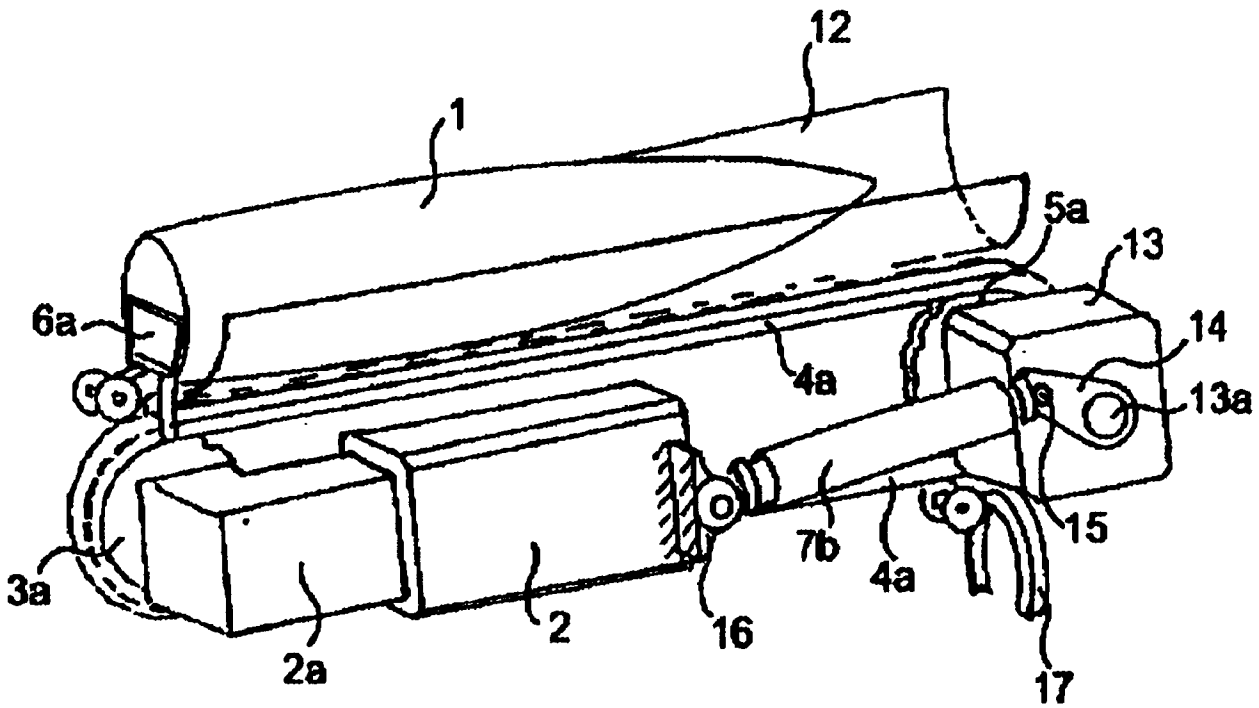
FIGS. 3 and 4 show a second variant of the invention in an angled projection and two different operating positions.
Figure 4:
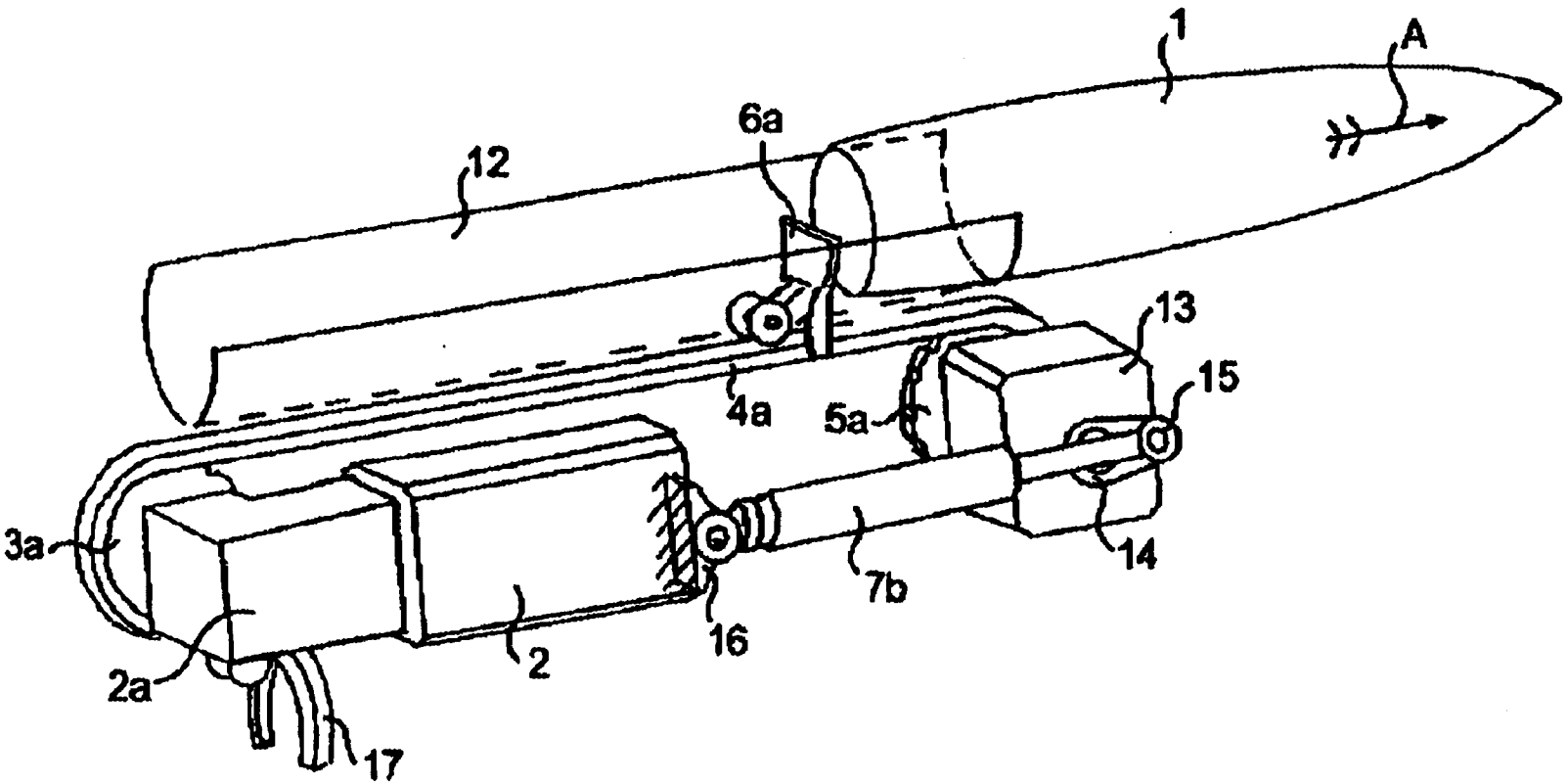

The variant of the arrangement according to the invention shown in FIGS. 3 and 4 includes the same electric motor 2 as in FIG. 2, and this motor drives, via a bevel gear 2*a*, a first chain wheel 3*a* which in turn drives a feed chain 4*a*. Mounted on the latter is a shell rammer 6*a* of slightly different design, which follows the movement (around the chain wheels) of the chain and in this way provides free access for supplying new shells from the rear. The shell rammer 6*a* is also provided with special rear guide wheels which follow guide tracks which are included in the shell cradle 12 shown in the figure but are themselves not shown in the figure. This is in order to provide guidance and absorb the torque transmitted by the shell. The shell cradle 12, in which the shell 1 rests during its acceleration, is also shown in the figures. The feed chain 4*a* runs on around a second chain wheel 5*a* which can be driven by or driving relative to the feed chain 4*a* depending on whether the shell 1 is to be accelerated or the energy accumulator 7*b*, also included here, is to be recharged. The spindle of the chain wheel 5*a* is connected to the input shaft of a planetary gear 13, on the output shaft 13*a* of which a toggle-joint arm 14 is firmly arranged. Fixed to the free outer end 15 of the toggle-joint arm 14 via a rotatable pin is one end of the energy accumulator 7*b* which here consists of a pneumatic spring. The other end of the pneumatic spring 7*b* is then in turn, via a second pin at point 16, connected to the frame (not shown in FIGS. 3 and 4) of the rammer. A stop 17 is also arranged firmly on the feed chain 4*a*. This stop is used to stop the shells 1 when they are supplied to the shell cradle 12 from the rear. As can be seen from the figure, the shell rammer 6*a* will be located on the lower side of the feed chain 4 when the stop 17 is located in a suitable stopping position on the upper side of the feed chain. The stop 17 is used in order to brake the shells when they are supplied to the shell channel 12, and at the same time the stop and the chain are displaced, the braking energy being used in order at least in part to recharge the energy accumulator, that is to say the pneumatic spring 7*b*.

In order for this variant of the invention to function correctly, it is necessary for the entire acceleration distance of the feed chain 4*a*, that is to say the distance between the starting and stopping positions of the pneumatic spring 7*b*, to correspond to half a revolution of the toggle-joint arm 14 arranged on the shaft of the planetary gear 13. The system comprising the toggle-joint arm 14 of the planetary gear and the pneumatic spring 7*b* has two dead-centre positions, the first of which arises when all its articulation points 13*a*, 15 and 16 lie in a line and the pneumatic spring 7*b* is fully compressed. A second dead-centre position lies half a revolution from the first, with the pneumatic spring 7*b* fully expanded. In this connection, however, bringing about rapid energy transmission is of greater interest than using the energy accumulator to its absolute maximum. In order to obtain maximum acceleration from the pneumatic spring 7*b*, a starting position must be selected in which the toggle-joint arm has already left the dead-centre position and forms an angle with this position. A starting angle of roughly 30° from the dead-centre position has proved to be suitable. At the same time, a limited amount of the accumulated energy of the energy accumulator is therefore sacrificed because the latter is in this position discharged slightly, and at the same time, as the total stroke length is to correspond to half a revolution of the output shaft of the planetary gear, braking of the system is obtained at the end of the stroke, which brings about an initial prestressing of the energy accumulator. This braking will, however, affect only the shell rammer 6*a* because the shell 1 will in this position have reached its maximum velocity. FIG. 4 shows the position immediately before this braking is started.

The arrangement functions in the following manner: In the starting position, the shell 1 is located in the shell cradle 12, while the pneumatic spring 7*b* and the toggle-joint arm 14 are in the position described above directly at the side with the spring fully compressed, and the motor 2 keeps the system balanced. When the shell 1 is to be rammed, the motor 2 is started, whereupon the feed chain 4 starts to move and with it the chain wheel 5*a* which rotates the planetary gear 13, and at the same time the toggle-joint arm 14 is driven in the same direction by the energy accumulator, that is to say the pneumatic spring 7*b*. By virtue of the fact that the planetary gear is connected to the chain wheel 5*a*, the pneumatic spring 7*b* therefore delivers its energy supply in this way to the feed chain 4*a*, while the motor provides its energy supply to the same feed chain 4*a* via the chain wheel 3*a*. This combined energy supply then accelerates the shell 1. In the position shown in FIG. 4, the energy accumulator 7*b* has delivered all its energy, and the shell 1 has reached the desired velocity and continues its flick course forward for ramming in the ramming position (not shown) of the piece. Of the previously mentioned half revolution of the output shaft of the planetary gear, only a small part now remains, which involves an initial prestressing of the pneumatic spring 7*b*, and the energy necessary for this prestressing can be obtained from rapid braking of the shell rammer 6*a*which has now completed its function as far as this shell is concerned. Braking of the shell rammer is effected by the pneumatic spring and motor together. For the remaining recharging of the pneumatic spring, use can then be made of the energy which is absorbed by the stop 17 when it stops the next shell fed in, supplemented with the remaining energy necessary from the motor. Moreover, the recharging of the energy accumulator can also be carried out by the motor 2 being reversed by an amount corresponding to half a revolution of the planetary gear.

Figure 5:
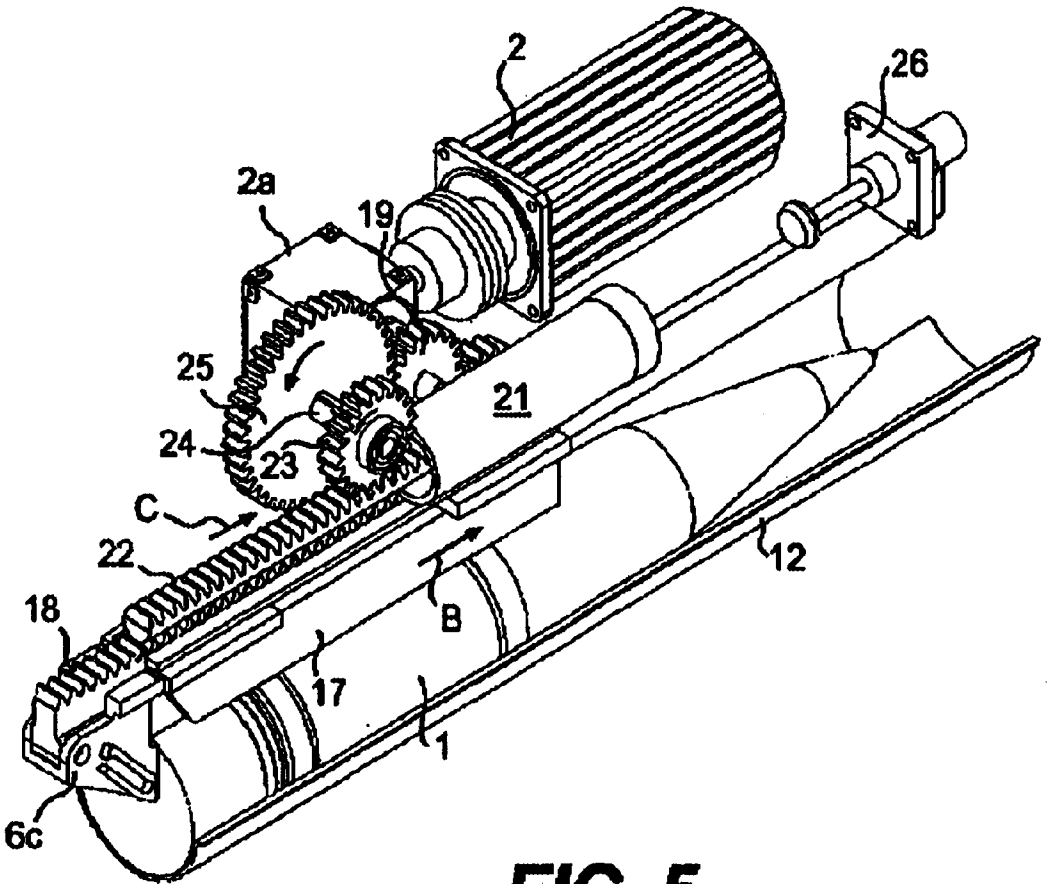
FIGS. 5, 6 and 7 show angled projections of a third variant of the invention, FIG. 5 showing the arrangement with the shell in the starting position, FIG. 6 the arrangement with the shell in the launching position and FIG. 7 the main component parts of the drive system with the shell in the starting position.
Figure 6:
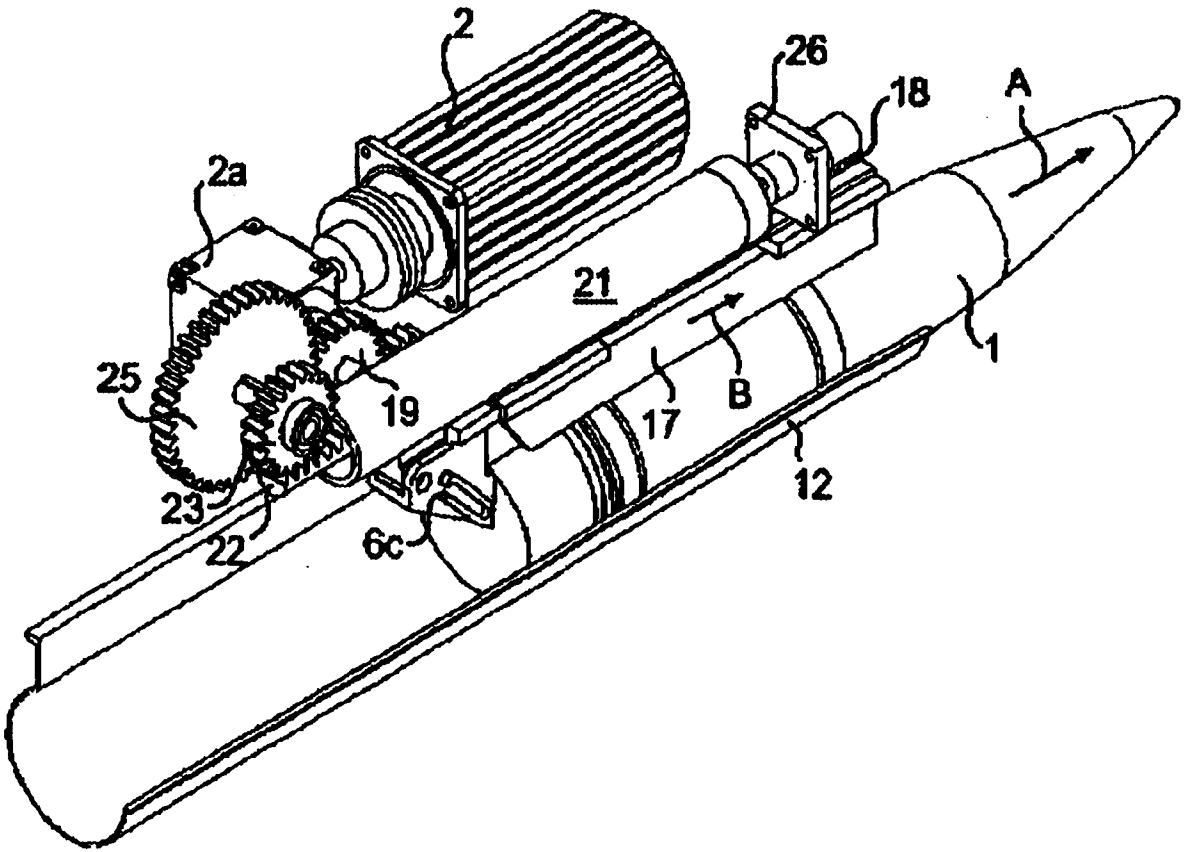
Figure 7:
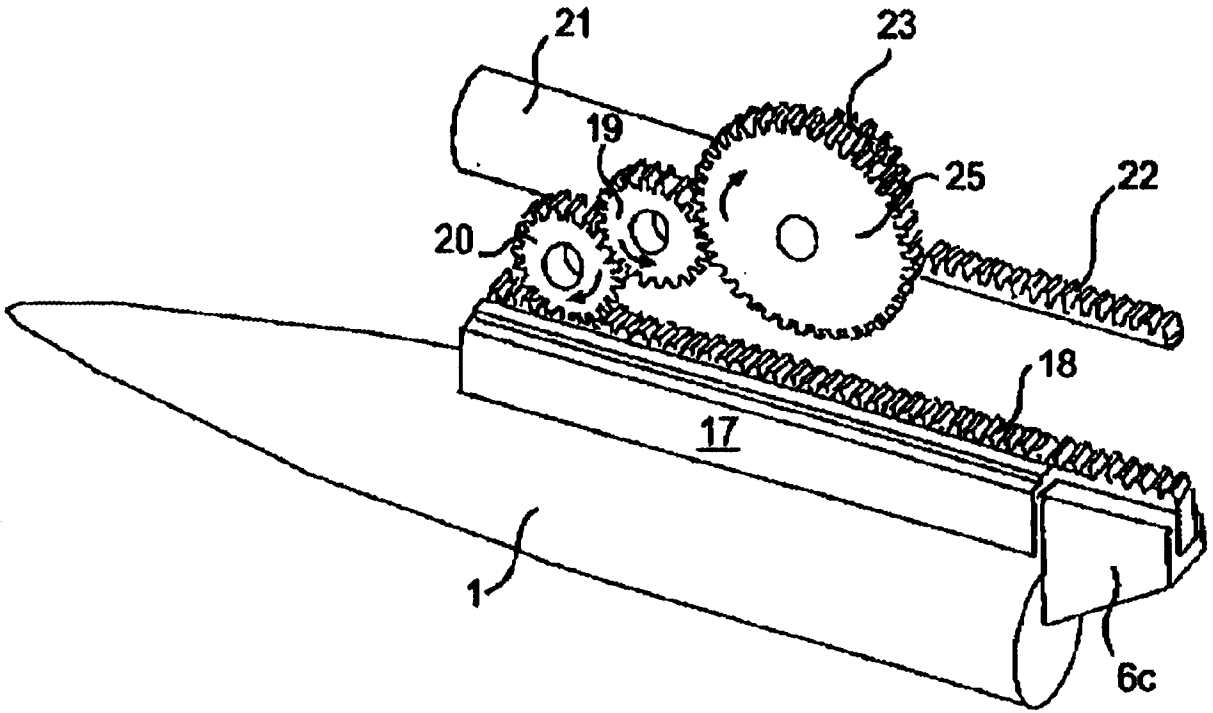

The basic principle underlying the arrangement shown in FIGS. 5, 6 and 7 is that the rotation movement of the electric motor is to be converted into a linear movement by means of a pinion which drives a rack, and the same basic idea is used for transmitting the energy supply from the energy accumulator to the shell, which in this case is effected by this energy supply being transmitted to the drive wheel of the motor and from there, together with the energy supply from the motor itself, to the shell rammer. FIG. 5 shows the arrangement with the shell in the starting position, FIG. 6 shows the shell when it has achieved its maximum acceleration, and FIG. 7 shows chiefly how the gearwheels concealed in the other figures interact with one another and the rack which drives the shell. A number of the component parts shown in the other figures have been omitted in FIG. 7.

The arrangement shown in FIGS. 5 and 6 and partly in FIG. 7 comprises the shell 1, the shell cradle 12 and the drive motor 2 with its bevel gear 2*a*, which can all be unmodified. A shell rammer 6*c* is also included, which is in principle of the previously indicated type. The latter is included in the form of a fixed part in a rammer body 17 which is arranged displaceably in the direction of the arrow B in a frame (not shown in the figure) which also supports the shell cradle 12. The rammer body 17 also includes a fixed rack 18. When the motor 2 is started, it drives, via a bevel gear 2*a*, a pinion 19 (see also FIG. 7) which in turn drives a pinion 20 which drives the rack 18 and with it the rammer body 17 in the direction of the arrow B. The rammer body 17 also includes a spring holder tube 21 containing a powerful coil spring which, in the compressed state, will drive a second rack 22 in the direction of the arrow C. The rack 22 then in turn engages with a pinion 23 which is mounted firmly on the same spindle 24 as an intermediate gear 25 which is in turn in engagement with the pinion 19 of the motor. As in the previous alternative, this fundamental solution of the invention means that, when the piece is to be loaded, the motor is switched from its braking function and is started, its starting acceleration then beginning, via the pinions 19 and 20, to drive the rack 18 and with it the rammer body 17 in the direction of the arrow B. At the same time, the rack 22 is allowed to begin moving in the direction of the arrow C by the spring in the spring holder tube 21 driving it forwards, energy thus released being supplied via the pinion 23 and the intermediate gear 25 to the motor and being in this way converted into shell acceleration in the direction of the arrow B. FIGS. 6 and 7 also include a brake 26 for braking the rammer body 17 after acceleration of the shell has been completed.

Figures 8, 10:
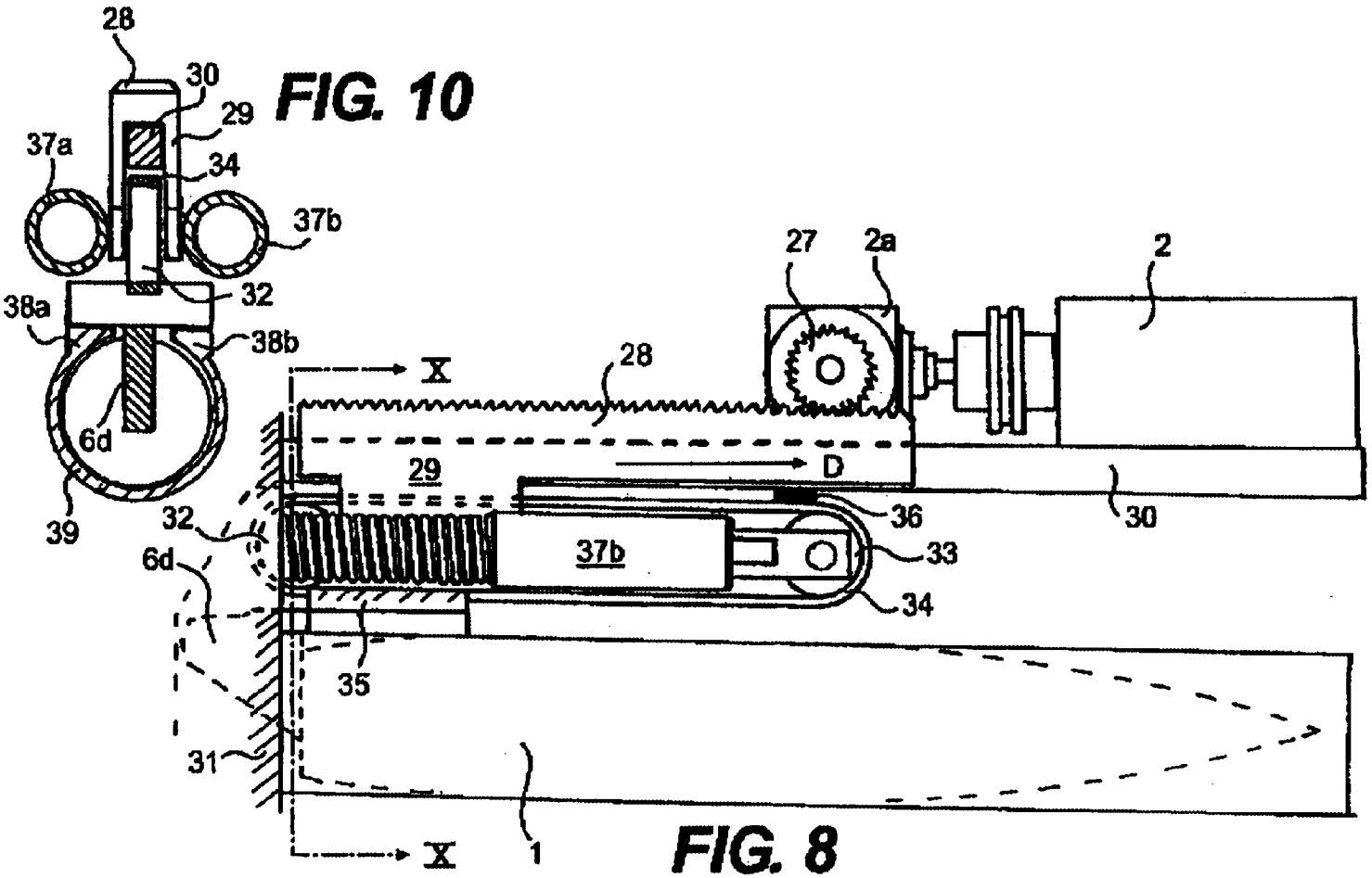
FIGS. 8 and 9 show a lateral projection and, respectively, a vertical view of another embodiment of the invention.
FIG. 10 shows the section X—X in FIG. 8.
Figure 9:
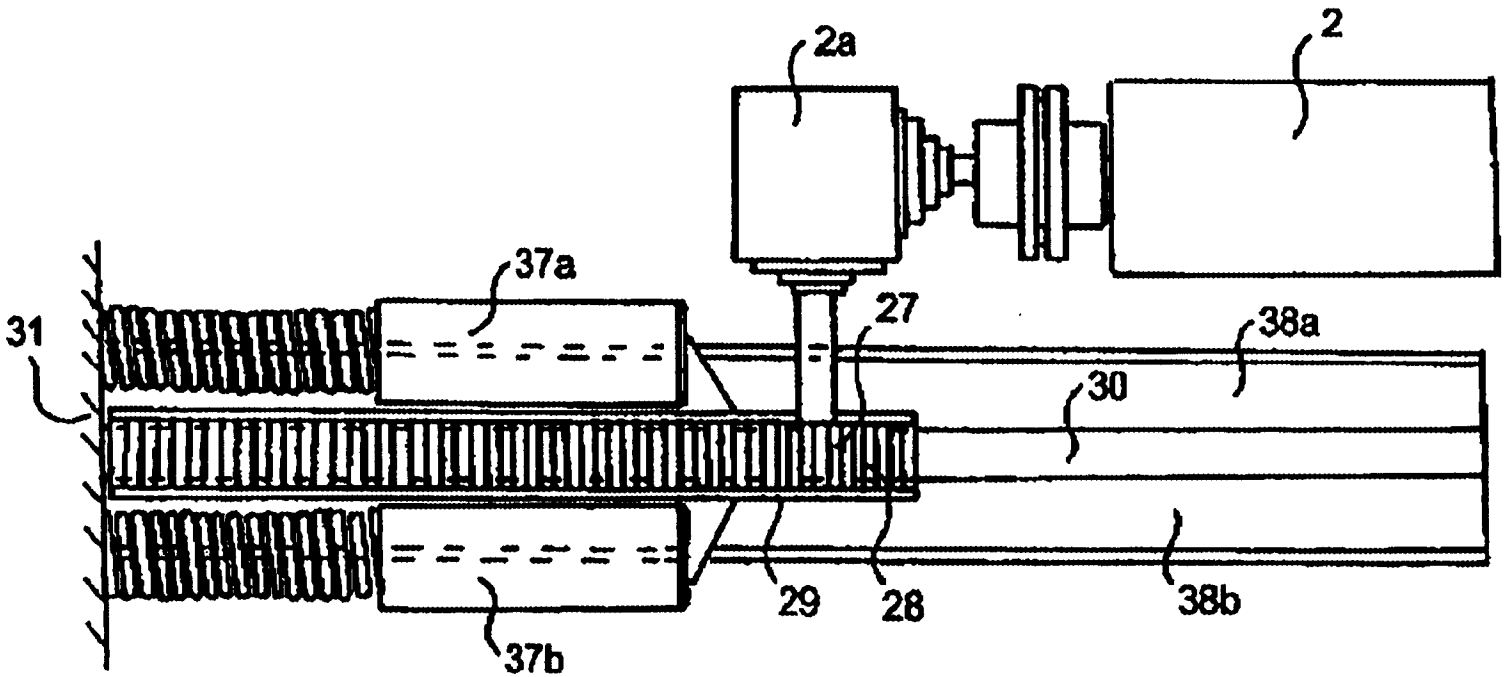

Finally, the variant of the invention shown in FIGS. 8, 9 and 10 comprises a bevel gear 2*a* which is driven by an electric motor 2 and the output shaft of which is provided with a pinion 27 which, when the motor rotates, displaces a rack 28 and frame, of which it forms part, in the direction of the arrow D. This is because the whole frame 29 can be disposed along a guide rail 30, and this guide rail constitutes an integral part of the basic body 31 of a loading system. Also arranged in the frame 29 are two guide wheels 32 and 33, and a feed chain 34 runs around these. A shell rammer 6*d* is also fastened on the feed chain 34 at the level of the marking 35. The feed chain 34 is moreover connected firmly to the guide rail 30 at point 36. Two energy accumulators 37*a* and 37*b* are also included, which are fastened one on either side of the frame 29. When these energy accumulators, which consist of coil springs, are triggered, they will act on the frame in the same direction as the motor because they are fixed between the moving frame 29 and the basic body 31. When the motor is started, it drives the frame 29 via the pinion 27 and the rack 28 in the direction of the arrow D. The feed chain 32 and with it the shell rammer 6*d*follow in the same direction. By virtue of the feed chain being connected firmly to the guide rail 30 and therefore, via the latter, to the basic body 31, each displacement of the frame 29 in the direction of the arrow D along the guide rail 30 will result in twofold displacement of the feed chain 34 and the shell rammer 6*d* connected to it. The system therefore gives a ratio of 2 to 1 for the movement of the chain and thus also of the shell rammer in relation to the movement of the frame, and the latter obtains its movement energy via on the one hand the starting acceleration of the motor and on the other hand the simultaneously triggered energy accumulators 37*a* and 37*b*. Finally, it can be seen from the figures that the shell rammer 6*d* is mounted along two guide rails 38*a* and 38*b* which form part of the shell cradle 39 which is in the form of a slotted tube 39. As previously, the reference number of the shell is 1.

What is claimed is:

1. A flick ramming method of loading an artillery piece with a projectile component in the form of either a shell or a propellant powder charge, the method comprising:

providing electronechanical energy from an electric motor;

converting a rotational acceleration of the electric motor into a rectilinear acceleration;

accumulating energy in an energy accumulator;

converting energy released from the energy accumulator to a rectilinear acceleration;

simultaneously releasing the energy accumulated in the energy accumulator and combining the rectilinear acceleration of the energy accumulator with the rectilinear acceleration of the electric motor in a loading direction of the projectile component to accelerate the projectile component to the ramming velocity; and applying the rectilinear acceleration to the projectile component to accelerate the projectile component to a ramming velocity inside a barrel of the artillery piece during a loading operation.

2. The method of claim 1, wherein said accumulating energy in an energy accumulator comprises compressing at least one spring.

3. The method of claim 1, further comprising, after the loading operation has been completed, using the electric motor to reaccumulate energy in the energy accumulator.

4. An apparatus for flick loading an artillery piece with a projectile component in the form of either a shell or a propellant powder charge, the apparatus comprising:

an electric motor having a rotational acceleration;

mechanical conversion means for converting the rotational acceleration of the electric motor into a linear acceleration;

a rammer operatively coupled to the mechanical conversion means, said rammer applying the linear acceleration to the projectile component in a manner which imparts a ramming velocity to the projectile component within a barrel of the artillery piece; and an energy accumulator coupled to the rammer, said energy accumulator being arranged and adapted to release stored energy in a manner which augments the linear acceleration resulting from the conversion of the rotational acceleration of the electric motor, and which thereby assist, in imparting the ramming velocity to the projectile component, said energy accumulator releasing the stored energy simultaneously with a starting of the electric motor.

5. The apparatus of claim 4, wherein said electric motor comprises a gear-down electric motor coupled to the mechanical conversion means.

6. The apparatus of claim 4, wherein the mechanical conversion means for converting the rotational acceleration of the electric motor into a linear acceleration comprises:

a first feed chain running in a closed loop in a desired loading direction of the projectile component and being arranged to drive the rammer;

a first chain wheel connected to an output shaft of the electric motor and around which the first feed chain runs;

a second chain wheel arranged in a running direction of the first feed chain and around which the first feed chain also runs;

a second feed chain mechanically coupled to the energy accumulator, said second feed chain being in a closed loop which runs parallel to the first feed chain around third and fourth chain wheels, one of said third and fourth chain wheels being mounted on a same spindle as the second chain wheel of the first feed chain;

said third and fourth chain wheels being arranged to rotate and drive in a same direction when they are acted on by either the electric motor or the energy accumulator.

7. The apparatus of claim 6, wherein a movement of the first and second feed chains activated by the electric motor in a direction opposite to the loading direction results in an accumulation of energy in the energy accumulator while the shell rammer returns to a starting position, wherein a movement of the first and second feed chains in the loading direction brings about an acceleration of the rammer and the projectile component while energy is supplied from both the electric motor and the energy accumulator.

8. The apparatus of claim 4, wherein said mechanical conversion means for converting the rotational acceleration of the electric motor into a linear acceleration comprises a pinion which is driven by the electric motor, said pinion being arranged to bear against a first rack connected to the rammer, wherein the energy accumulator comprises at least one spring and a second rack which is displaceable relative at least with respect to the first rack when the at least one spring is not a fixed position, wherein the energy accumulator is operatively coupled to a drive shaft of the electric motor via one or more opinions.

9. The apparatus of claim 4, wherein said mechanical conversion means for converting the rotational acceleration of the electric motor into a linear acceleration comprises:

a pinion mounted on in output shaft of the electric motor; and a rack which drives a displaceable frame, said displaceable frame bearing a feed chain arranged to run around fist and second chain wheels in a closed loop, said displaceable frame being connected, in one of two parallel running portions, to a body of the apparatus in which the displaceable frame is displaceable and, in the other of the two parallel running portions, to the rammer, wherein at least one energy accumulator is arranged between a fixed a fixed position of the apparatus and the displaceable frame.

10. The apparatus of claim 4, further comprising means for starting a release of an energy supply from the energy accumulator at a same time as the electric motor is started.

11. The apparatus of claim 4, further comprising means for loading the electric motor in a direction which brakes a triggering of the energy accumulator until a time of ramming when a current direction to the electric motor is reversed.

12. An loader for flick loading an artillery piece with a projectile component in the form of either a shell or a propellant powder charge, the apparatus comprising:

a feed chain running around first and second chain wheels in a closed loop, wherein the second chain wheel is suitably arranged for either driving the feed chain during a projectile component loading operation, or for being driven by the feed chain during an energy charging operation;

an electric motor arranged to drive the feed chain via the first chain wheel;

a shell rammer connected to the feed chain;

a planetary gear connected to the second chain wheel of the feed chain and having an output shaft;

a crank arm connected to the output shaft of the planetary gear; and a compressible element connected between an outer end of the crank arm and a fixed fastening point on the loader.

13. The loader of claim 12, wherein a full stroke length of the compressible element corresponds to half a revolution of the output shaft of the planetary gear and the crank arm connected to the end of the output shaft, wherein, when the crank arm is in a starting position which corresponds to a starting position of the shell rammer, the compressible element is in a compressed position such that the crank arm forms an angle with respect to a line connecting the fixed fastening point on the loader and the output shaft of the planetary gear, wherein, when the crank arm is in a stopping position which corresponds to a stopping position of the shell rammer, the compressible element remains in a compressed position resulting from utilizing braking energy released during a braking operation of the shell rammer, after the projectile component has been accelerated into a final loading position.

14. The loader of claim 12, wherein the electric motor is arranged to be driven in either a loading direction which accelerates the projectile component into a ramming position, or in an energy recharging direction which compresses the compressible element.

15. The loader of claim 12, further comprising:

a feed chain which drives the shell rammer;

a stop connected to the feed chain which brakes the projectile component being loaded by the loader, wherein energy supplied to the stop during braking of the projectile component is utilized to drive the planetary gear in a direction which aids the electric motor in further compressing the compressible element to a charged condition.

* * * * *